United States Patent [19]

East

[11] 4,227,740

[45] Oct. 14, 1980

[54] ATTACHMENT FOR A WHEELCHAIR

[76] Inventor: Robert C. East, 2097 S. Devinney St., Lakewood, Colo. 80228

[21] Appl. No.: 29,454

[22] Filed: Apr. 12, 1979

[51] Int. Cl.[3] ..... A47C 7/38

[52] U.S. Cl. ..... 297/310; 297/397; 297/DIG. 4; 297/391

[58] Field of Search ..... 297/310, 397, 391, 394, 297/DIG.4

[56] References Cited

U.S. PATENT DOCUMENTS

| | | | |
|---|---|---|---|
| 3,256,040 | 6/1966 | Mize et al. | 297/310 |
| 3,371,959 | 3/1968 | Gordin | 297/310 |
| 3,497,259 | 2/1970 | Sherfey | 297/391 |
| 3,674,310 | 7/1972 | Montagano | 297/DIG. 4 |
| 3,759,544 | 9/1973 | Korpela | 297/DIG. 4 |
| 3,779,599 | 12/1973 | Gottfried | 297/397 |

*Primary Examiner*—Francis K. Zugel
*Attorney, Agent, or Firm*—Phillip L. De Arment

[57] ABSTRACT

The attachment comprises two U-shaped tubular members joined at their open ends and offset from each other by an adjustable obtuse angle. Material providing a head rest is secured to one of the U-shaped members adjacent its closed end and a non-skid material is applied to the closed end of the other U-shaped member. The ends of the other U-shaped member are offset at an angle to facilitate insertion into the tubular handles of a wheelchair. With the attachment secured to the wheelchair, the chair can be tipped backwards and is supported by the closed end of the other U-shaped member. Two additional straps extend about the one U-shaped member below the head rest to support the upper back of the wheelchair occupant.

10 Claims, 6 Drawing Figures

ATTACHMENT FOR A WHEELCHAIR

BACKGROUND OF THE INVENTION

Patients who are required to spend considerable time in a wheelchair experience discomfort associated with the design of the commonly used wheelchairs. Two notable problems experienced with such wheelchairs are lack of any support for the head and upper back area and requiring the patient to maintain the same posture while seated. The latter problem causes "bedsores" particularly in the buttocks due to the weight distribution imposed on a patient sitting upright for prolonged periods of time. The former problem causes general patient discomfort and fatigue due to lack of support for the head and upper body.

These problems have been addressed by the prior art which proposes various solutions. U.S. Pat. Nos. 2,986,200 and 3,712,671 suggest innovative wheelchair configurations which tilt to permit the patient to assume a reclined position. Such wheelchairs are not available to many patients due to cost thereof. U.S. Pat. No. 3,881,773 suggest a modification to a wheelchair to include an innovative back which can tilt to permit the patient to recline. This proposed solution is likewise costly. U.S. Pat. No. 3,674,310 provides a relatively low cost solution to these problems by suggesting a head rest attachment for a standard wheelchair. The disadvantage of this device is that tilting of the chair can only be accomplished at fixed locations since it requires a cooperating hook to be mounted in a fixed support such as a wall which engages the upper handgrip of the attachment.

It is therefore an object of the present invention to provide a relatively inexpensive attachment for common wheelchairs which is readily attachable to the wheelchair, is safe to use, provides head and shoulder support which can be adjusted for the particular patient combination wheelchair and supports the chair when tilted to redistribute the patient's weight or change the body pressure points on the chair and provides the comfort of a reclining position.

BRIEF DESCRIPTION OF THE DRAWINGS

These and other objects are accomplished by the present invention which will be subsequently described in conjunction with the accompanying drawings in which.

DESCRIPTION OF THE PREFERRED EMBODIMENT

Figure 1:
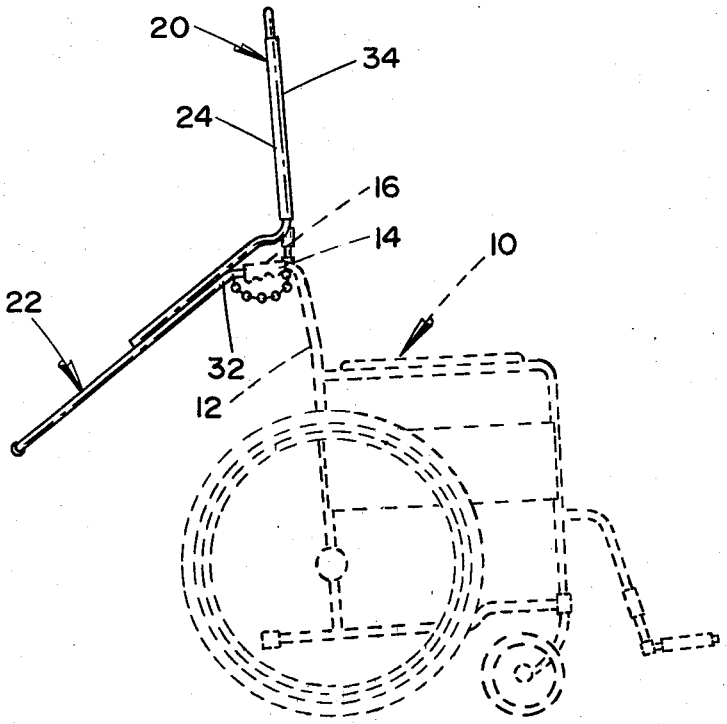
FIG. 1, is a side elevation of a commonly available wheelchair with the attachment embodying the present attached to the handles thereof.
Figure 3:
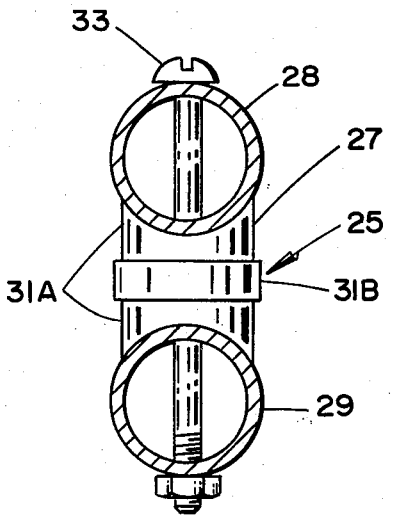
FIG. 3, is a sectional view of the attachment taken substantially along line 3—3 of FIG. 1.

FIG. 1, discloses wheelchair 10 which is commonly formed of hollow tubing and includes uprights 12 terminating in handles 14. Handles 14 are hollow, parallel and normally have grips 16. The attachment 20 according to the present invention is adapted to connect to handles 14 of the wheelchair.

Figure 2:
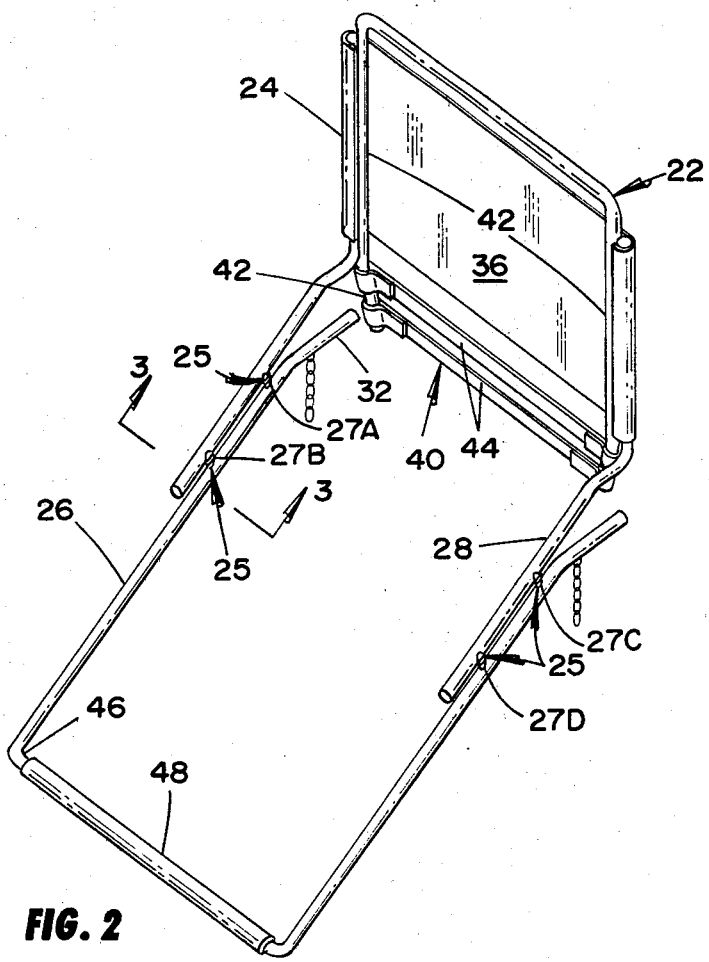
FIG. 2, is a perspective view of the attachment according to the present invention.

Attachment 20 comprises frame means 22 which preferably is constructed from lightweight 0.5 inch diameter steel tubing. Frame means 22 comprises a substantially U-shaped head supporting frame portion 24 connected at its open end to open end of a substantially U-shaped chair supporting frame portion 26 as shown in FIG. 2. An adjustable connecting means 25 functions to connect frame portions 24 and 26 in a manner to permit adjustment of head portion 24 as indicated by numeral 30.

Connecting means 25 comprise four spacer sets 27A, 27B, 27C, 27D which function to adjustably space ends 28 of frame portion 24 relative to intermediate sections 29 of frame portion 26. The illustrated spacer sets 27A and 27C include three spacers 31A, 31B. Spacers 31A have semi-circular recesses to mate with tubular frame portions 28 and 29 and spacer 31B is rectangular-shaped and is positioned intermediate spacers 31A as illustrated. Spacer sets 27B and 27D include two spacers 31A each. Each spacer 31 has a central recess to receive a suitable fastener 33 therethrough to effect connection between frame portions 28 and 29.

It should be apparent that by adding or removing spacers 31B, the obtuse angular relationship between frame portions 24 and 26 as indicated by arrow 30 can be adjusted. Hence, each head rest can be adjusted to suit each patient.

The tubular ends 32 of the chair support frame portion 26 are offset as illustrated providing an attachment section. Ends 32 in the preferred embodiment are adapted and sized to slide into and frictionally engage the inside of tubular handles 14 and effect connection of the attachment 20 to the wheel chain 10. Experience has shown the frictional connection adequately holds the attachment to the wheelchair. However, caution demands that a positive mechanical interlock be used to secure the connection. Any of the prior art connectors such as a pin projecting through aligned holes in handles 14 and ends 32 would be adequate.

Figure 5:
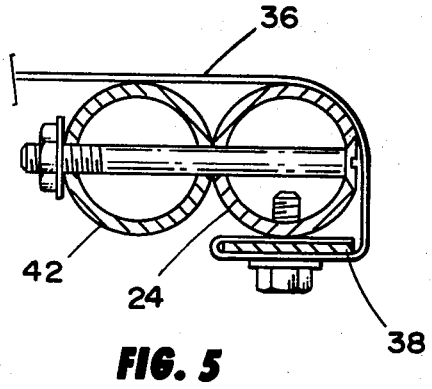
FIG. 5, is a sectional view of the attachment taken substantially along line 5—5 of FIG. 4.

Head support means 34 comprise material 36, such as plastic coated fabric such as nylon extends across head frame portion 24 as illustrated and is connected thereto by an elongated metal strap 38 (FIG. 5) having a plurality of holes along its length. The ends of material 36 are wrapped around straps 38 and holes in the material 36, straps 38 and tubular member of frame portion 24 are aligned and suitable fastening means, such as screws, secure the material to the frame portion 24 as illustrated in FIG. 5. The material provides a comfortable head rest for the patient with or without a pillow.

Figure 4:
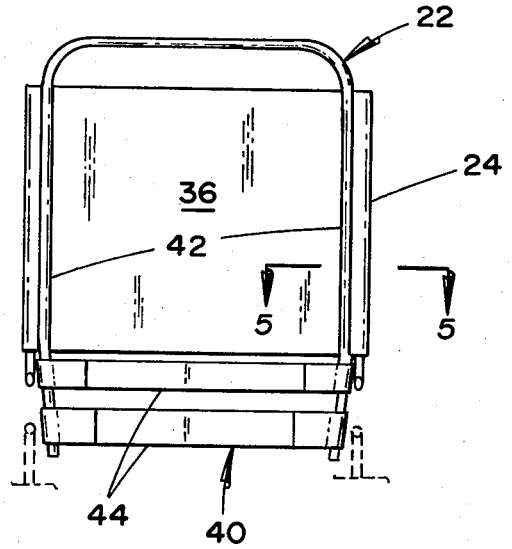
FIG. 4, is a partial elevational view of the back of the attachment.

An upper back support means 40 comprises tubular members 42 bolted to the tubular member comprising frame portion 24 as illustrated in FIG. 4. The lower ends project downward beyond the lower edge of material 36 and support one or more straps 44. Straps 44 may be continuous strip such as a belt which extends around the lower ends of members 42 and secured by a keeper or buckle. Alternatively, straps may be made of continuous elastic material which may be stretched over members 42 and released. Obviously, such alternative type of straps will not provide the support that the belted strap provides. One advantage of using two narrower straps as opposed to one wider strap is the capability of individual adjustment of each strap to accommodate a patient's anatomy and comfort. Another advantage provided by the upper back support means 40 is the support it lends to the wheelchair back. When the attachment 20 is in place, the lower strap 44 will be positioned behind the fabric back of wheelchair 10, thus relieving the strain which would otherwise exist in the back material when the wheelchair assumes the tilted position.

Figure 6:
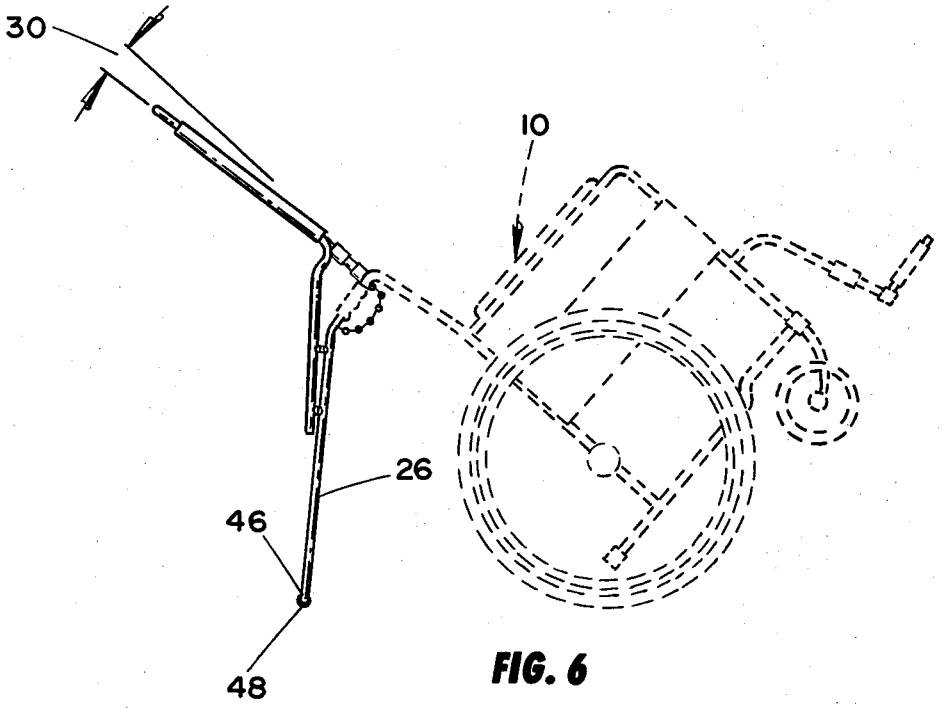
FIG. 6, is a side elevational view similar to FIG. 1 which illustrates the wheelchair in its tilted condition.

The wheelchair 10 may be tilted as illustrated in FIG. 6. Tilting the patient redistributes the patient's pressure areas in contact with the wheelchair and thereby minimizing "bedsores" that may otherwise occur. In addition, tilting improves the patient's circulation and general comfort.

The tilted wheelchair is supported by engagement of the closed end 46 of frame portion 26 providing a stable support for the tilted chair. A piece of rubber 48 or other material having high resistance to skidding or sliding may be applied to end 46 to resist movement of the wheelchair while in its tilted configuration.

It should be apparent the geometry of the frame means 22 and other described features of the preferred embodiment are choices dictated by cost and safety consideration since an important object of this present invention is to provide a safe, comfortable and relatively low cost attachment for the most commonly used wheelchairs. Hence, more patients may avail themselves of the benefits provided by the present invention. However, deviation from the preferred embodiment may be depending on the available materials and tooling without departing from the scope of the appended claims.

Having described my invention, I claim:

1. An attachment for a wheelchair having rearwardly extending spaced handles adapted to be grasped by a person pushing the chair comprising frame means, connectable to the handles of a wheelchair to secure the frame means thereto and including a chair supporting frame portion and an integrally connected head supporting frame portion extending at an obtuse angle relative to said chair supporting frame portion, head support means secured to said head support frame portion for engaging and supporting the head of an occupant of the wheelchair and floor engaging means on said chair supporting frame portion for supporting the wheelchair when the chair is tilted backwards.

2. The attachment for a wheelchair as defined in claim 1, wherein said frame means comprises tubular members.

3. The attachment for a wheelchair as defined in claim 1, wherein said chair supporting frame portion and said head supporting frame portion comprise substantially U-shape members connected at their open ends and said head supporting frame portion having at its open end an attachment section which engages said chair supporting frame portion and extends at an obtuse angle relative to the remainder of said chair supporting frame portion.

4. The attachment for a wheelchair as defined in claim 3, wherein said chair supporting frame portion further includes at its open end a wheelchair handle engaging section offset at an angle to the remainder of said chair supporting frame portion and removably connectable to handles of a wheelchair to effect connection of said frame means to the wheelchair.

5. The attachment for a wheelchair as defined in claim 3, wherein said head support means includes material extending across said head supporting frame portion and the ends of the material extend around a metal strap connected to said head supporting frame portion, said straps, material and head supporting frame portion having aligned holes which receive a plurality of fasteners to securely fasten the material to the head supporting frame portion.

6. The attachment for a wheelchair as defined in claim 1, further including upper back supporting means on said chair supporting frame portion for engaging and supporting the upper portion of the back of an occupant of the wheelchair.

7. The attachment for a wheelchair as defined in claim 6, wherein said upper back supporting means comprises two elongated members secured to said head supporting frame portion and depending beyond the lower edge of said material and a strap extending between and supported by said elongated member beneath said material.

8. The attachment for a wheelchair as defined in claim 1, wherein said floor engaging means includes a surface having a high coefficient of friction.

9. The attachment for a wheelchair as defined in claim 1, further including means connecting said chair supporting frame portion and said head supporting frame portion to permit varying the obtuse angle to accommodate individual patient comfort.

10. The attachment as defined in claim 9, wherein said means connecting said chair supporting frame portion and said head supporting frame portion comprise a plurality of spacers engageable with said frame portions, each spacer having a central aperture for receiving a fastener to secure said frame portions.

* * * * *